United States Patent [19]

Masui et al.

[11] Patent Number: 4,827,190

[45] Date of Patent: May 2, 1989

[54] METAL VAPOR DISCHARGE LAMP AND METHOD OF PRODUCING THE SAME

[75] Inventors: Motonobu Masui; Yasuo Ban, both of Kumagaya, Japan

[73] Assignee: Iwasaki Electric Co., Ltd., Tokyo, Japan

[21] Appl. No.: 804,713

[22] Filed: Dec. 2, 1985

[51] Int. Cl.[4] ..... H01J 17/16

[52] U.S. Cl. ..... 313/624; 313/623; 313/625; 313/638; 313/639

[58] Field of Search ..... 313/623, 624, 625, 638, 313/639, 317, 634, 318, 571, 573, 574, 620

[56] References Cited

U.S. PATENT DOCUMENTS

| | | | |
|---|---|---|---|
| 3,054,922 | 9/1962 | Louden et al. | 313/624 |
| 3,248,590 | 4/1966 | Schmidt | 313/638 |
| 3,588,577 | 6/1971 | McVey | 313/624 |
| 3,642,340 | 2/1972 | Yamane et al. | 316/20 |
| 4,075,530 | 2/1978 | Furukubo et al. | 313/639 |
| 4,147,952 | 4/1979 | Webb et al. | 313/625 |
| 4,475,061 | 10/1984 | Van Weijer et al. | 313/623 |
| 4,545,799 | 10/1985 | Rhodes et al. | 313/623 |

FOREIGN PATENT DOCUMENTS

| | | |
|---|---|---|
| 53-17828 | 10/1978 | Japan . |
| 54-57376 | 5/1979 | Japan . |
| 58-182359 | 7/1983 | Japan . |
| 1168145 | 10/1969 | United Kingdom . |
| 2156147 | 2/1985 | United Kingdom . |

*Primary Examiner*—David K. Moore
*Assistant Examiner*—Michael Razavi
*Attorney, Agent, or Firm*—Armstrong, Nikaido, Marmelstein, Kubovcik & Murray

[57] ABSTRACT

A metal vapor discharge lamp has a luminous tube constituted by a translucent ceramic tube member, end caps hermetically fixed to both ends of the translucent ceramic tube member, and electrode supporting tubes hermetically inserted into respective end caps. One of the electrode supporting tubes serves also as an exhaust tube for evacuation and also as a reservoir for a metal charged in the luminous tube. The outer end extremity of this electrode supporting tube is hermetically sealed through fusion by application of heat. This hermetic seal is formed by fusing the end of the electrode supporting tube by application of heat thereto, while keeping a heat-shielding/absorbing plate held in close contact with the electrode supporting tube.

11 Claims, 3 Drawing Sheets

METAL VAPOR DISCHARGE LAMP AND METHOD OF PRODUCING THE SAME

BACKGROUND OF THE INVENTION

The present invention relates to a metal vapor discharge lamp having a translucent ceramic luminous tube and also to a method of producing such a metal vapor discharge lamp. More particularly, the invention is concerned with a luminous tube of the type mentioned above, provided with hermetic electrode supporting tubes attached to both ends thereof, as well as method of producing such a luminous tube.

In general, metal vapor discharge lamps having high luminous efficiency such as a high-pressure sodium lamp have a translucent ceramic luminous tube which is composed of a cylindrical ceramic tube member and ceramic or metallic end caps hermetically closing both ends of the ceramic tube member. The interior of the ceramic tube is charged with a metal such as mercury and sodium after evacuation.

Broadly, the method for hermetically sealing the luminous tube after charging with a metal can be sorted into two types: a method which does not make use of an exhaust tube and a method which makes use of exhaust tube.

In the first-mentioned method which employs no exhaust tube, a series of the steps such as evacuation of the interior of the ceramic tube member, charging with a metal and attaching of end caps to the ceramic tube member are conducted in a hermetic assembly room such as a bell-jar, employing a complicated assembly system. This method, therefore, is extremely difficult to conduct and can provide only a low efficiency of work.

For this reason, the second-mentioned method relying upon exhaust tube is more popular. FIG. 1 exemplarily shows a luminous tube with an exhaust tube. The luminous tube is composed of a ceramic tube member 1 and alumina end caps 2 and 3 attached to both ends of the ceramic tube member 1 by means of frit. Electrode supporting tubes 4 and 5 made of a heat-resistant metal such as niobium are fitted to the center of the end caps 2 and 3, respectively. The electrode supporting tubes 4 and 5 support respective electrodes at their inner ends which are projected into the tube member 1, thus serving as conductors for supplying electric power to the electrodes. One of the electrode supporting tubes, e.g., the electrode supporting tube 4, is intended for use as the exhaust tube, through which the interior of the luminous tube is evacuated and charged with a metal such as mercury and sodium. This electrode supporting tube 4, therefore, will be referred to as "exhaust electrode supporting tube", hereinunder.

This luminous tube, having an exhaust tube constituted by one of the electrode supporting tubes, is fabricated by the following method. As the first step, the electrode supporting tubes 4 and 5 are inserted into central holes formed in the alumina end caps 2 and 3. The electrode supporting tubes 4 and 5 are hermetically fixed to the alumina end caps 2 and 3 by means of a frit, simultaneously with the fixing of the alumina end caps 2 and 3 to the ceramic tube member 1. Subsequently, the outer end of the electrode supporting tube 5, which is not intended for use as the exhaust tube (referred to as "non-exhaust electrode supporting tube", hereinunder), is cut after a cold press-bonding followed by arc welding of the cut end as necessitated, thus forming an end seal 5' having a shape as shown in FIG. 1. Subsequently, the evacuation of the interior of the ceramic tube member 1 and the charging of the same with a metal are conducted through the exhaust tube constituted by the exhaust electrode supporting tube 4 and, thereafter, the outer end of the electrode supporting tube 4 is cold press-bonded and cut to form an end seal 4' in the same way as the sealing of the outer end of the electrode supporting tube 5.

When a luminous tube for a metal vapor discharge lamp such as a high-pressure sodium lamp is produced through the aid of the exhaust tube, the outer ends of the electrode supporting tubes are sealed by cold press-bonding followed by cutting, so that the end extremities 6 of these sealed ends have the form of blades as shown in FIG. 2A add are tipped to have reduced thickness as shown in FIG. 2B. In particular, both widthwise ends *6a, 6a* of each sealed end have an extremely small thickness and, hence, are liable to be damaged, causing a risk of leak. Therefore, the evacuation and sealing operation, as well as the mounting of the luminous tube in an outer bulb, have to be done with greatest care.

When the end seals of the electrode supporting tubes is conducted by cold press-bonding, the sealing operation has to be done after mounting, on the alumina end caps, not only the exhaust electrode supporting tube but also the non-exhaust electrode supporting tube. In consequence, a laborious work is required for hermetically fixing the end caps to the ends of the ceramic tube member.

In order to obviate the above-described problems, the present inventors have already proposed an improved metal vapor discharge lamp in Japanese Utility Model Laid-Open No. 182359/1983. In this metal vapor discharge lamp, as shown in FIG. 3, the outer end of the non-exhaust electrode supporting tube 5 is sealed hermetically by fusing the tube material by other means than the cold press-bonding, e.g., by an arc discharge, thereby forming a hermetic sealed end 5''. According to this method, the work for fusing and sealing the end of the non-exhaust electrode supporting tube 5 can be conducted without substantial difficulty and independently of the evacuation and charging of the interior of the ceramic tube member. In addition, since the attaching of the electrode supporting tube 5 to the associated end cap can be done after the sealing of the end of the tube 5, the tube 5 can be handled easily after it is hermetically attached to the end cap 3 of the ceramic tube member. In addition, the work for the assembly of the electrode supporting tube 5, the end cap 3 and the ceramic tube member 1 is facilitated, thus contributing greatly to the improvement in the efficiency of the work.

When the present inventors proposed this improved metal vapor discharge lamp, and even thereafter, it has been considered to be quite difficult to adopt the proposed sealing method to the sealing of the exhaust electrode supporting tube 4 and, therefore, the proposed sealing method has been applied only to the sealing of the end of the non-exhaust electrode supporting tube 5.

More specifically, the exhaust electrode supporting tube 4 has to be sealed in the final step of the production process after the charging with the metal in the ceramic tube member. In other words, this electrode supporting tube 4 cannot be sealed before the mounting on the associated end cap, unlike the non-exhaust electrode supporting tube 5.

When the exhaust electrode supporting tube is sealed by the fusing-type sealing method in the final step of the production process, the heat of the arc welding for fusing the end of the electrode supporting tube adversely affects the glass frit by which the end cap is hermetically fixed to the end of the ceramic tube member and also the charged metal carried by the electrode supporting tube. This problem is serious particularly in the case where the exhaust electrode supporting tube serves also as a metal reservoir in which the charged metal is reserved. Namely, in such a case, the charged metal is evaporated and scattered by the heat generated during the sealing operation, and is mixed into the fused end of the electrode supporting tube, causing troubles such as leak during operation of the luminous tube. In addition, since the charged metal absorbs impurity gases evaporated from the material of the electrode supporting tube, the purity of the charged metal is impaired to adversely affect the operation characteristics of the product luminous tube.

For these reasons, the sealing of the exhaust electrode supporting member has been conducted by cold press-bonding followed by cutting. The problem therefore still remains in connection with the likelihood of damaging of the sealed end 4' of the exhaust electrode supporting tube 4 and reliability is still low with regard to the sealed end 4', requiring a greatest care in the handling of the luminous tube after the sealing.

Another problem is encountered when the exhaust electrode supporting tube is used also as the metal reservoir. Namely, a temperature gradient appears during operation of the metal vapor discharge lamp such that the outermost end of the exhaust electrode supporting tube experiences the lowest temperature. The vapor pressure in the luminous tube and, hence, the lamp voltage are changed in relation to a change in this lowest temperature. This means that the length of projection of the exhaust electrode supporting tube beyond the end cap, which affects the temperature of the coldest outer end extremity of this electrode supporting tube, is a significant factor which determines the lamp voltage. Thus, the projection length has to be designed and selected in due consideration of the lamp voltage.

This, however, goes quite contrary to the demand from the view point of production. Namely, when the sealing of the exhaust electrode supporting tube is conducted by cold press-bonding after the mounting on the end cap, a considerable length of the electrode supporting tube has to be projected beyond the end cap, in order to prevent the juncture between the end cap and the electrode supporting tube from being affected by the deformation of the electrode tube end caused by the cold press-bonding. In addition, in order to make sure of the tight seal of the end of the electrode supporting tube by the cold press-bonding, the press-bonding has to be done over a substantial length. This means that the electrode supporting tube has to be prepared in a large length, resulting in an inefficient use of the expensive material such as niobium. Thus, the length of projection of the exhaust electrode supporting tube has to be determined also taking these factors into account.

Thus, when the electrode supporting tube is sealed by the cold press-bonding, it is quite difficult to determine projection length of the electrode supporting tube beyond the end cap on the basis of the lamp voltage solely, and the actual determination of the projection length encounters various restrictions.

It is to be pointed out also that, when the sealing is conducted by the cold press-bonding, the projection length and the shape of the electrode supporting tube fluctuate largely, resulting in fluctuation of the temperature at the coldest end of the electrode supporting tube, which in turn causes a variation in the lamp voltage of the metal vapor discharge lamp as the product.

The sealing of the end of the exhaust electrode supporting tube 4 by cold press-bonding causes also a problem in connection with a minute gap 7 which is formed in the sealed portion 4' as shown in FIG. 2B. Namely, during the operation of the lamp, the region around this minute gap 7 constitutes the coldest portion in the luminous tube, so that the charged metal such as sodium amalgam tends to invade this minute gap 7. The sodium amalgam thus trapped in the minute gap tends to evaporate as the lamp is started again but cannot evaporate perfectly. In consequence, the operation characteristics tend to be degraded particularly in the case of lamps in which the amount of the charged metal is small or in the case of so-called unsaturated-type sodium lamp.

SUMMARY OF THE INVENTION

Accordingly, an object of the invention is to provide a metal vapor discharge lamp having a ceramic luminous tube which suffers from only a small lamp voltage fluctuation and which exhibits improved starting characteristics, higher reliability of the seal of the electrode supporting tube and higher rate of utilization of expensive material, as well as a method for producing such a metal vapor discharge lamp, thereby overcoming the above-described problems of the prior art.

To this end, the invention in its one aspect provides a metal vapor discharge lamp having a luminous tube constituted by a translucent ceramic tube member, end caps hermetically fixed to both ends of the translucent ceramic tube member, and electrode supporting tubes hermetically inserted into respective end caps such as to partly project outwardly from the translucent ceramic tube, one of the electrode supporting tubes being an exhaust electrode supporting tube which serves also as an exhaust tube for evacuation and also as a reservoir for a metal charged in the luminous tube, the outer end extremity of the one of the electrode supporting tubes constituting the coldest portion of the metal vapor discharge lamp during the operation of the tube, wherein improvement comprises that the outer end of at least the one of the electrode supporting tubes is hermetically sealed through fusion by application of heat.

With this arrangement, the projection length of the electrode supporting tube which constitutes the coldest portion of the luminous tube can be determined freely in consideration of the lamp voltage, without substantially taking into account other factors. By virture of this feature, the fluctuation of the lamp voltage is reduced and the lampstarting characteristics are improved advantageously. In addition, the reliability of the seal on the end of the electrode supporting tube is improved because there is no thin-walled blade end portion on the electrode supporting tube, unlike the discharge lamp produced by the cold press-bonding.

The present invention provides in its another aspect a method of producing a metal vapor discharge lamp comprising the steps of: preparing a first electrode supporting tube having an electrode fixed to the inner end thereof and unsealed at its outer end, the first electrode supporting tube serving also as an exhaust tube for evacuation and as a reservoir for storing a charged metal, and preparing also a second electrode supporting tube having an electrode fixed to the inner end thereof and hermetically sealed at its outer end; inserting the first and second electrode supporting tubes to respective end caps; hermetically fixing the end caps to respective ends of a translucent ceramic tube; placing the assembly of the translucent ceramic tube, the end caps and the electrode supporting tubes in a hermetic vessel and then evacuating the interiors of the hermetic vessel and the translucent ceramic tube, followed by charging of an inert gas and charging of a metal in the first electrode supporting tube with the unsealed end; expelling the inert gas and charging the hermetic vessel and the translucent ceramic tube with a lamp starting gas up to a predetermined pressure; and sealing the unsealed outer end of the first electrode supporting tube through fusion by application of heat, with a heat-shielding/absorbing plate held in close contact with the projected outer end portion of the first electrode supporting tube within the atmosphere of the lampstarting gas.

According to this method, when the end of the exhaust electrode supporting tube is fused by application of heat during sealing process, the end of the electrode supporting tube can be cooled and solidified without delay by virture of the presence of heat-shielding/absorbing plate which effectively absorbs the heat. The heat-shielding/absorbing plate effectively shields and absorbs the heat applied during the sealing operation, so that the undesirable evaporation of the charged metal in the electrode supporting tube can be prevented, thereby obviating various troubles which may otherwise be caused during the lamp operation, such as the leak attributable to the fusion of the evaporated material into the sealed portion of the tube and the deterioration of the operation characteristics of the luminous tube. For the same reason, the reliability of the hermetic seal of the tube is enhanced and the fluctuation of the lamp voltage is suppressed advantageously.

The above and other objects, features and advantages of the invention will become clear from the following description of the preferred embodiment when the same is read in conjunction with the accompanying drawings.

DESCRIPTION OF THE PREFERRED EMBODIMENT

The invention will be described hereinunder with reference to the accompanying drawings.

Figure 1:
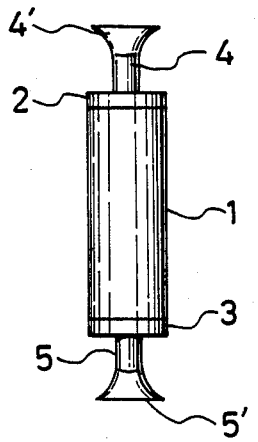
FIG.1 PRIOR ART
FIG. 1 is a plan view of a luminous tube incorporated in a conventional metal vapor discharge lamp.
Figure 3:
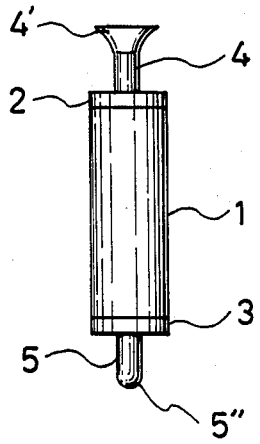
FIG.3 PRIOR ART
FIG. 3 is a plan view of a luminous tube of a known metal vapor discharge lamp proposed by the present
Figure 2:
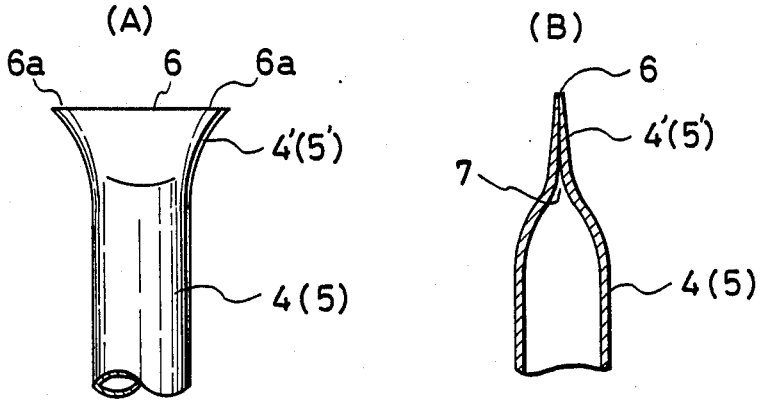
FIG.2 PRIOR ART
FIGS. 2A and 2B are an enlarged plan view and a sectional view of a hermetically sealed portion of an electrode supporting tube in the luminous tube shown in FIG. 1.
Figure 4:
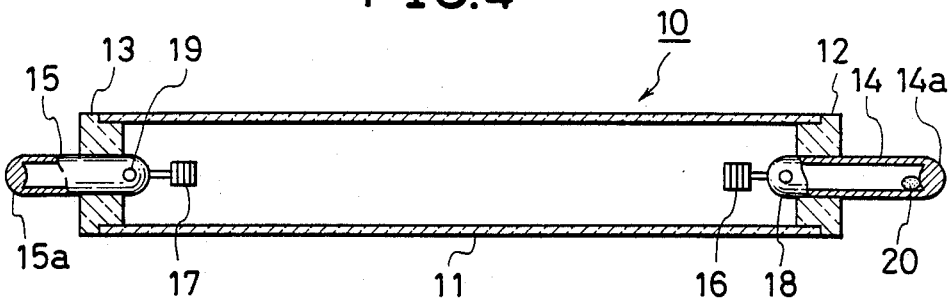
FIG. 4 is a partly-sectioned plan view of an example of the luminous tube incorporated in a metal vapor discharge lamp in accordance with an embodiment of the invention.

Referring first to FIG. 4 which is a partly-sectioned plan view of an example of a luminous tube used in a metal vapor discharge lamp embodying the present invention, the luminous tube generally designated by a reference numeral 10 has a translucent ceramic tube member 11 made of translucent alumina. End caps 12 and 13 which also are made of alumina are hermetically attached to both ends of the ceramic tube member 11, through the intermediary of frit. The end caps 12 and 13 are provided with central holes which receive, respectively, electrode supporting tubes 14 and 15 made of niobium. The electrode supporting tubes 14 and 15 are hermetically fixed to the end caps through frit. Electrodes 16 and 17 are supported by the inner ends of the electrode supporting tubes 14 and 15, respectively.

One of the electrode supporting tubes, the supporting tube 14 in this case, is utilized as an exhaust tube through which the interior of the ceramic tube member 11 is evacuated and then charged with a charged metal. The evacuation and charging are conducted through an exhaust hole 18 and the outer end opening of the tube 14. After the evacuation and charging, the outer end of the exhaust electrode supporting tube 14 is closed by fusion such as to form a hermetic sealed end **14*a* having a relatively thick outer end portion with a convex outer surface. In this state, the exhaust electrode supporting tube 14 has a tubular form with a closed bottom. The exhaust electrode supporting tube 14 projects outwardly beyond the end cap 12 by a distance which is greater than the length of projection of the other electrode supporting tube 15 beyond the end cap 13, so that the coldest portion is formed on the outer end of the electrode supporting tube 14**.

The other electrode supporting tube 15 is not designed for use as an exhaust tube. Before the evacuation through the exhaust electrode supporting tube 14, the non-exhaust electrode supporting tube 15 is subjected to the same sealing operation as the exhaust electrode supporting tube, i.e., closing by fusion such as to form a hermetic sealed end **15*a*, thus having a tubular form with a closed bottom in the form of a relatively thick end wall with convex outer and inner surfaces. A reference numeral 19 denotes a hole which is formed in the wall of the non-exhaust electrode supporting tube 15 for allowing the air in the tube 15 to escape, thus preventing trapping of air in the electrode supporting tube 15, while a numeral 20 designates a charged metal which in this case is sodium amalgam. The charged metal is charged in the electrode supporting tube 14 in advance of the sealing operation. When the lamp is not operating, the sodium amalgam is accummulated in the electrode supporting tube 14. During the operation of the lamp, the sodium amalgam is evaporated and diffused into the luminous tube 10 by an amount corresponding to the temperature of the outer end of the electrode supporting tube 14**.

This luminous tube 10 is mounted in an outer bulb (not shown) known per se by a known measure, thus forming a metal vapor discharge lamp.

As will be understood from the foregoing description, according to the invention, at least one of the electrode supporting tubes which serves also as an exhaust tube and a reservoir for the charged metal is closed by fusing at its outer end, thus forming a hermetic sealed end. Therefore, the fragile thin-walled blade end, which heretofore has been formed when the sealing is conducted by cold press-bonding, is eliminated such as to ensure a high reliability of the sealed end. For the same reason, the fluctuation in the projection length of the electrode supporting tube is suppressed advantageously. It is to be understood also that the operation characteristics of the metal vapor discharge lamp, particularly in the unsaturated-type lamp, is improved remarkably because of elimination of the minute gap which is inevitably formed in the coldest sealed end of the electrode supporting tube in the conventional luminous tube sealed by cold press-bonding.

Figure 5:
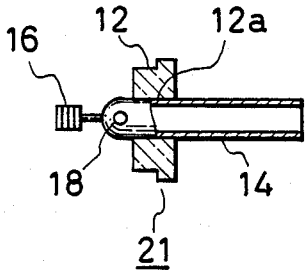
FIG. 5 is a sectional view of an end cap holding an exhaust electrode supporting tube.

A description will be made hereinunder as to the method of producing a metal vapor discharge lamp of the invention having the described embodiment. As the first step of the production process, the electrode supporting tube 14 made of niobium, intended for use also as an exhaust tube, is inserted into the central through hole 12*a* in the alumina end cap 12 having a disk-like form, through an intermediary of a frit, thus completing one end cap assembly 21 as shown in FIG. 5. The electrode supporting tube 14 is beforehand provided with the exhaust hole 18 formed therein and with the electrode 16 attached thereto.

Figure 6:
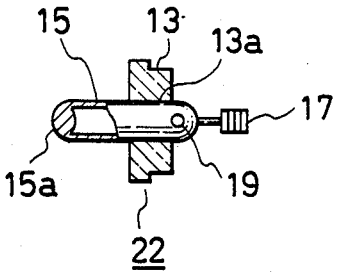
FIG. 6 is a sectional view of an end cap holding a non-exhaust supporting tube.
Figure 7:
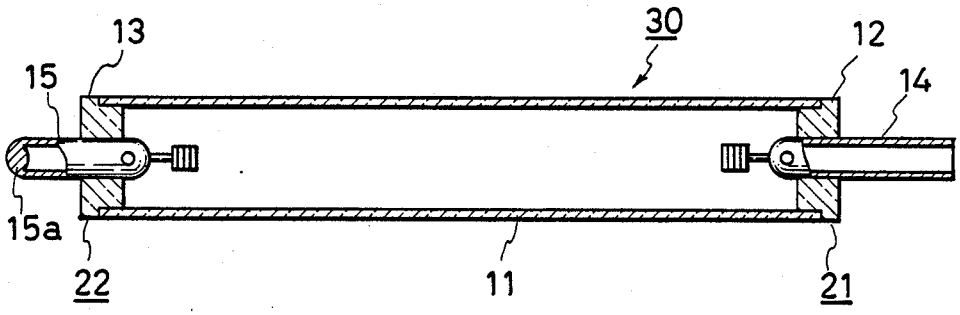
FIG. 7 is a partly-sectioned plan view of a luminous tube assembly.

Subsequently, s shown in FIG. 6, the other electrode supporting tube 15 which is not intended for use as the exhaust tube also is formed from niobium, with the electrode 17 fixed to one end thereof and with its outer end 15*a* hermetically sealed by fusion through, for example, an arc welding such as TIG welding conducted in argon gas. As stated before, the electrode supporting tube 15 is provided with a hole 19 for preventing air from being trapped in the tube 15. However, this hole 19 may be omitted provided that the juncture between the electrode 17 and the electrode supporting tube 15 is hermetically sealed to such a degree as not to permit air in the tube 15 from escaping into the luminous tube. This electrode supporting tube 15 is inserted into the central through hole 13*a* of the disk-shaped alumina end cap 13, through the intermediary of a frit, thus completing the other end cap assembly 22. The end cap assemblies 21 and 22 are then hermetically fixed to both ends of the ceramic tube member 11 by fusion through a frit as shown in FIG. 7, thereby closing both ends of the ceramic tube member 11. Meanwhile, the electrode supporting tubes 14 and 15 also are hermetically fixed by fusion through the frit to respective end caps 12 and 13, such that the electrode supporting tubes 14 and 15 project over predetermined lengths beyond the end caps 12 and 13. More specifically, the projection length of the electrode supporting tube 15 is selected to be smaller than the projection length of the electrode supporting tube 14 which is determined such that the projection length after the sealing by fusion corresponding to the lamp voltage to be obtained.

Figure 8:
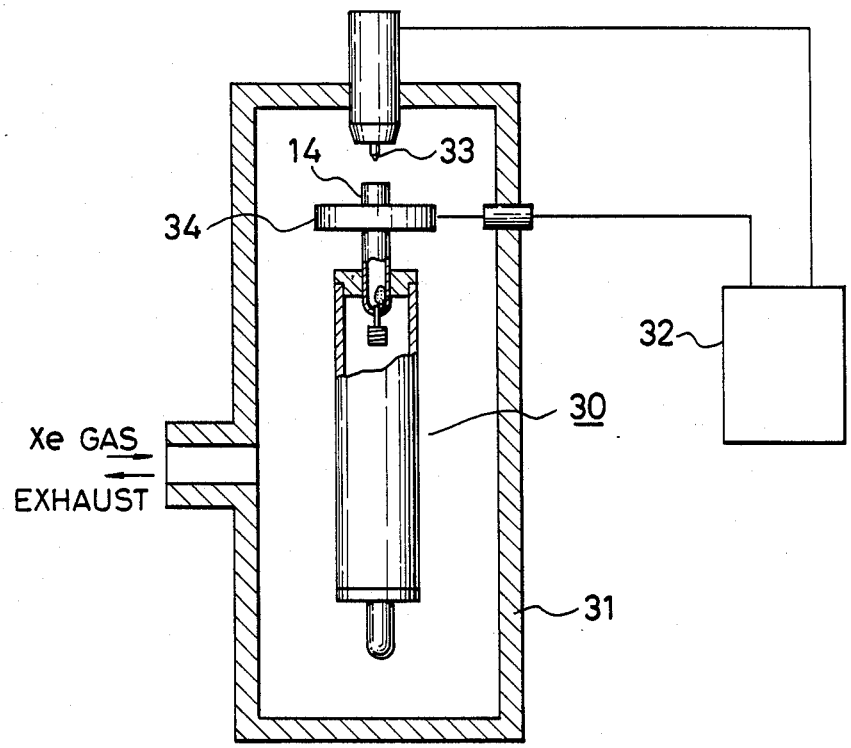
FIG. 8 is an illustration of a system suitable for use in the sealing of the luminous tube assembly.

The ceramics tube 11, end caps 12, 13 and the electrode supporting tubes 14, 15 hermetically assembled together constitute a luminous tube assembly which is generally designated at a numeral 30. The luminous tube assembly 30 thus formed is placed in a hermetic vessel 31 which is shown in FIG. 8. A discharge electrode 33 connected to one of the output terminals of an arc generator 32 of an arc welder is disposed in the vessel 31 such as to oppose the outer end of the exhaust electrode supporting tube 14 of the luminous tube assembly 30. A heat-shielding/absorbing plate 34 is disposed to tightly fit on the projected portion of the electrode supporting tube 14 such as to be held in close contact with the same. The heat-shielding/absorbing plate 34 is connected to the other output terminal of the arc generator 32. The heat-shielding/absorbing plate 34 is preferably made of a material which has a high heat conductivity, as well as high resistance both to heat and arc. A typical example of such a material is molybdenum. When the heat-shielding/absorbing plate 34 is made of an electrically non-conductive material, the other output terminal of the arc generator 32 is connected directly to the electrode supporting tube 14.

Subsequently, the interior of the hermetic vessel 31 is evacuated and is charged with argon gas. Then, a predetermined amount of mixture of sodium and mercury, i.e., sodium amalgam, is charged into the unsealed electrode supporting tube 14. Then, after evacuating the interior of the hermetic vessel 31 to a high degree of vacuum, the interior of the hermetic vessel 31 and, hence, the interior of the luminous tube assembly, are charged with xenon gas which is a starting gas for the luminous tube up to a pressure of 15 to 350 Torr. The xenon gas is bound to remain in the luminous tube after the sealing of the tube. After the charging with the xenon gas, arc generator 32 is actuated to effect an arc discharge between the exhaust electrode supporting tube 14 and the opposing discharge electrode 33, using the xenon gas as a discharge gas. In consequence, the outer end of the electrode supporting tube 14 is molten and solidified, such as to form a hermetic sealed end 14*a* similar to the hermetic sealed end 15*a* of the non-exhaust electrode supporting tube 15, thus completing a luminous tube 10 as shown in FIG. 4. The thus formed luminous tube 10 is mounted in an outer bulb (not shown) known per se by a known method, whereby a metal vapor discharge lamp is completed.

During the sealing of the outer end of the exhaust electrode supporting tube 14 by arc discharge, the melting of the outer end of the electrode supporting tube 14 does not propagate beyond the heat-shielding/absorbing plate 34 which is held in contact with the electrode supporting tube 14 and, as the arc discharge is ceased, the molten end portion of the electrode supporting tube 14 is solidified without delay, thus forming a hermetic sealed end 14*a*. It is, therefore, possible to constantly obtain a desired projection length of the electrode supporting tube 14 after the sealing, by suitably selecting the position of the heat-shielding/absorbing plate 34 with respect to the electrode supporting tube 14 on which it is tightly fitted.

The heat-shielding/absorbing plate 34 offers another advantage in that it effectively absorbs the heat produced by the arc discharge so as to prevent the heat from adversely affecting the glass frit between the electrode supporting tubes 14, 15 and th associated end caps 12, 13, as well as the glass frit between the end caps 12, 13 and adjacent ends of the ceramic tube 11. The heat-insulating/absorbing plate 34 also prevents heating and evaporation of the sodium amalgam as the charging metal so as to avoid the undesirable fusion of the evaporated sodium amalgam into the fused portion of the electrode supporting tube 14. For the same reason, any impediment on the sealing arc discharge, due to contamination of the inner wall of the hermetic vessel 31 by sodium amalgam attaching thereto, is avoided conveniently.

In the described embodiment of the method of the invention, the outer end of the electrode supporting tube is directly fused and sealed by arc discharge without any mechanical processing, this is not exclusive and the end of the electrode supporting tube may be sealed in two steps: namely, a mechanical work for collapsing and flattening the tube end for facilitating a subsequent sealing by fusion, and the fusion for sealing the tube end. Obviously, the sealing of the electrode supporting tube may be conducted by other means than the described arc discharge, e.g., by means of a laser. The sealing of the outer end of the non-exhaust electrode supporting tube 15 may be effected under atmospheric pressure by means of, for example, a commercially available torch.

The described embodiment of the production method in accordance with the invention shows only the basic form of the invented method in which only one luminous tube assembly is procesed at one time within the hermetic vessel. This, however, is not exclusive and the arrangement may be such that a multiplicity of luminous tube assemblies 30 are disposed in the hermetic vessel 31 and corresponding discharge electrodes 33 are placed in face-to-face relation to the exhaust electrode supporting tubes 14 of the luminous tube assemblies 30 or, alternatively, such that a single discharge electrode is movable to face the exhaust electrode supporting tube 14 of successive luminous tube assemblies. With such an arrangement, it is possible to conduct the evacuation and sealing operation on a multiplicity of luminous tube assemblies concurrently or successively.

Table 1 shows the result of an experiment which was conducted to examine the fluctuation of lamp voltage in the metal vapor discharge lamps incorporating the luminous tubes produced by the method described hereinbefore, in comparison with the lamp voltage fluctuation in the conventional metal vapor discharge lamps in which the sealing of the exhaust electrode supporting tube is carried out by cold press-bonding.

TABLE 1

| | Conventional lamps | | Lamps of invention | |
|---|---|---|---|---|
| | lot 1 | lot 2 | lot 1 | lot 2 |
| n | 97 | 99 | 99 | 98 |
| $\overline{V}_l$ | 129 | 131 | 131 | 129 |
| $\sigma$ | 5.79 | 5.63 | 3.32 | 3.43 |

In Table 1 above, a symbol n represents the number of the discharge lamps employed in the test, while $\overline{V}l$ represents the mean value of the lamp voltages. The fluctuation of the lamp voltage is expressed in terms of fluctuation factor $\sigma$.

From Table 1, it will be understood that the metal vapor discharge lamps in accordance with the invention exhibits much smaller lamp voltage fluctuation as compared with the conventional metal vapor discharge lamps. This owes to the facts that the shape of the sealed end of the exhaust electrode supporting tube is simplified by virture of the adoption of fusion type sealing method, and that the length of projection from the luminous tube is regulated thanks to the provision of the heat-shielding/absorbing plate which permits the control of position where the hermetic seal is formed on the end of the exhaust electrode supporting tube.

These advantageous effects are derived from the elimination of fluctuation of the projection length of the electrode supporting tube serving also as an exhaust tube and a metal reservoir, the end extremity of the projected end of this tube constituting the coldest portion of the metal vapor discharge lamp. Thus, these advantageous effects have nothing to do with the length of the projection of the other electrode supporting tube which does not constitute the coldest portion. That is, the advantage of the invention is never impaired even when the other non-exhaust electrode supporting tube is sealed by other means than the fusion by application of heat, although the sealing of this tube by fusion as in the described embodiment is preferred from the view point of reliability of the seal.

What is claimed is:

1. A method of producing a metal vapor discharge lamp comprising the steps of:

preparing a first electrode supporting tube having an electrode fixed to the inner end thereof and unsealed at its outer end, said first electrode supporting tube serving also as an exhaust tube for evacuation and as a reservoir for storing a charged metal, preparing a second electrode supporting tube having an electrode fixed to the inner end thereof and heretically sealed at its outer end;

inserting said first and second electrode supporting tubes to respective end caps;

hermetically fixing said end caps to respective ends of a translucent ceramic tube;

placing the assembly of said translucent ceramic tube, said end caps and said electrode supporting tubes in a hermetic vessel;

evacuating the interiors of said hermetic vessel and said translucent ceramic tube, followed by charging of an inert gas and charging of a metal in said first electrode supporting tube with the unsealed end;

expelling said inert gas and charging said hermetic vessel and said translucent ceramic tube with a lamp starting gas up to a predetermined pressure;

providing a heat-shielding/absorbing plate in close contact with the projected outer end portion of said first electrode supporting tube; and sealing said unsealed outer end of said first electrode supporting tube through fusion by application of heat while maintaining said heat-shielding/absorbing plate in close contact with said projected outer end portion of said first electrode supporting tube within the atmosphere of said lamp starting gas.

2. A method of producing a metal vapor discharge lamp according to claim 1, wherein the charged metal is sodium amalgam.

3. A method of producing a metal vapor discharge lamp according to claim 1, wherein said lamp starting gas is xenon gas.

4. A method of producing a metal vapor discharge lamp according to claim 2, wherein said lamp starting gas is xenon gas.

5. A method of producing a metal vapor discharge lamp according to claim 3, wherein said xenon gas is charged up to a pressure of 15 to 350 Torr.

6. A method of producing a metal vapor discharge lamp according to claim 4, wherein said xenon gas is charged up to a pressure of 15 to 350 Torr.

7. A method of producing a metal vapor discharge lamp according to claim 1, wherein the outer end of said first electrode supporting tube is sealed through fusion by an arc discharge effected in said xenon gas.

8. A method of producing a metal vapor discharge lamp according to claim 2, wherein the outer end of said first electrode supporting tube is sealed through fusion by an arc discharge effected in said xenon gas.

9. A method of producing a metal vapor discharge lamp according to claim 1, wherein said heat-shielding- /absorbing plate is mounted on the portion of said first electrode supporting tube adjacent the portion to be sealed.

10. A method of producing a metal vapor discharge lamp according to claim 2, wherein said heat-shielding-/absorbing plate is mounted on the portion of said first electrode supporting tube adjacent the portion to be sealed.

11. A method of producing a sealed metal vapor discharge lamp of the type which includes an elongate luminous tube having an electrode supporting tube projecting from each end thereof comprising the steps of:

providing an elongate translucent ceramic tube having an aperture at each end thereof;

preparing a first electrode supporting tube having an electrode fixed to the inner end thereof and unsealed at its outer end, said first electrode supporting tube serving also as an exhaust tube for evacuation and as a reservoir for storing a charged metal;

preparing a second electrode supporting tube having an electrode fixed to the inner end thereof and hermetically sealed at its outer end;

inserting said first and second electrode supporting tubes to respective ones of said apertures at each end of said translucent ceramic tube;

placing the assembly of said translucent ceramic tube, and said electrode supporting tubes in a hermetic vessel;

evacuating the interior of said hermetic vessel and said translucent ceramic tube;

charging said hermetic vessel with an inert gas;

charging a metal in said first electrode supporting tube;

expelling said inert gas and charging said hermetic vessel and said translucent ceramic tube with a lamp starting gas up to a predetermined pressure;

providing a heat-shielding/absorbing plate in close contact with the projected outer end portion of said first electrode supporting tube; and sealing said unsealed outer end of said first electrode supporting tube through fusion by application of heat while maintaining said heat-shielding/absorbing plate in close contact with said projected outer end portion of said first electrode supporting tube within the atmosphere of said lamp starting gas.

* * * * *